United States Patent [19]

Weil

[11] 4,341,524

[45] Jul. 27, 1982

[54] WORKING HEAD FOR A PASSEPARTOUT-MACHINE

[76] Inventor: Hans H. Weil, Östra Tullgatan 8, S-211 20 Malmö, Sweden

[21] Appl. No.: 129,382

[22] PCT Filed: May 25, 1979

[86] PCT No.: PCT/SE79/00120

§ 371 Date: Jan. 29, 1980

§ 102(e) Date: Jan. 25, 1980

[87] PCT Pub. No.: WO79/01139

PCT Pub. Date: Dec. 27, 1979

[51] Int. Cl.[3] ..... B26D 1/02

[52] U.S. Cl. ..... 493/355; 83/455; 493/372; 493/340

[58] Field of Search ..... 493/340, 372, 355, 65, 493/61, 468; 83/455, 482, 508, 925 CC

[56] References Cited

U.S. PATENT DOCUMENTS

| | | | |
|---|---|---|---|
| 3,477,322 | 11/1969 | Gerber et al. | 83/925 CC |
| 3,511,123 | 5/1970 | Smith | 83/482 |
| 3,511,124 | 5/1970 | Bruns | 83/925 CC |
| 3,967,519 | 7/1976 | Esterly | 83/455 |
| 4,047,457 | 9/1977 | Stubbings | 83/925 CC X |

FOREIGN PATENT DOCUMENTS

| | | | |
|---|---|---|---|
| 1561740 | 5/1970 | Fed. Rep. of Germany | 83/455 |

*Primary Examiner*—James F. Coan

*Attorney, Agent, or Firm*—Larson & Taylor

[57] ABSTRACT

The invention relates to a working head for a so called passepartout-machine by means of which rectangular cuttings and/or impressions can be made in a plain material and which is formed with a knife (6) or an impression roller which is mounted in a holder (30) which is connected to a rotatable housing (5) for being lifted and lowered. A pressure roller (7) adapted to be in contact with the plain material is likewise connected to the rotatable housing (5) for being lifted and lowered. The rotatable housing (5) is fixed connected to a central shaft (2) at the upper end of which a Maltese cross (14) is mounted and which by engagement with a cam disc (9) having a pin (10) and provided on a driving shaft (1) for the Maltese cross (14) can be rotated intermittently, so that the central shaft (2) is rotated one forth of a turn when the driving shaft (1) is rotated a full turn. The Maltese cross (14) has recesses (16) for a movable locking wedge (34) which locks the central shaft (2) after the rotation. The locking wedge (34) is a part of a catch (33) made of several pieces.

14 Claims, 6 Drawing Figures

WORKING HEAD FOR A PASSEPARTOUT-MACHINE

The present invention relates to a working head in an apparatus for providing rectangular cuttings in and/or impressions on a plain material. Especially the invention relates to a cutting head for a passepartout-machine having a holder for a knife and/or an impression roller which can be raised, rotated and lowered.

When cutting a passepartout, i.e. a border of cardboard or similar material for an artistic work or a photo the picture is normally measured by means of a measuring rod, corner points are marked on a cardboard disc and thereafter the various sides are cut out by hand. Thereby the cut out sides have to be bevelled. This method is time consuming and necessitates some skill of the operator since there is a great risk of false cutting, especially at the corners.

Different apparatus for facilitating the provision of rectangular cuttings have been proposed such as adjustable angle frames and moveable angle rules which may even carry a knife which can be moved along one side at a time. The U.S. Pat. No. 3,967,519 describes an apparatus for cutting passepartouts and similar means comprising a knife holder and a rotatable knife blade which can be moved along a groove on a substrate. With the knife in lowered position one side is first cut out and thereafter the knife must be raised and rotated and thereafter lowered for each corner, which is made manually by different movements by the hand. The working head according to the invention is characterized in that the holder for the knife and/or the impression roller is connected to a rotatable housing for being raised and lowered respectively, and a pressure roller which is intended to contact the material during the working is connected to the rotatable housing to be raised and lowered. The rotatable housing is fixedly connected to a central shaft at the upper part of which a Maltese cross is connected and the said central shaft can be rotated intermittently by engagement by a pin cam disc on a driving shaft of the Maltese cross so that the central shaft is rotated one forth of a turn when the driving shaft is rotated one turn.

By using a working head according to the present invention it is possible to automatically obtain a cutting of a corner as follows: When the cutting of one side is finished the holder for the knife is raised into resting position when the driving shaft is rotated, it is rotated 90° and is thereafter lowered to working position without any hand movements. Thereby a substantial saving of time and simplification is obtained in cutting a passepartout as compared with the previously known techniques, and also an exact precision cutting is obtained.

A cutting head according to the invention may preferably be used together with a passepartout-machine of the type which is described in the German Pat. No. 26 52 531.5 and which is further illustrated in the following. Thereby it is possible to quite automatically cut a complete passepartout whereby the cutting head is raised, rotated and lowered at each corner and is moved between the corners during the cutting.

The working head according to the invention also can be used for providing an impression or a pattern on a passepartout or any other plain object. For making those cuttings and impressions at the same time of a passepartout both a knife and an impression roller may be connected to the holder, whereby the impression roller can be brought to roll on until the corner impression is full filled when the knife has reached the corner and stopped.

For a passepartout normally cardboard is used, but also paper, plastic, metal foil or similar material of course can be used if wanted. The intended material, however, should be substantially plain.

The invention will now be described more closely with reference to the accompanying drawings of which:

Figure 1:
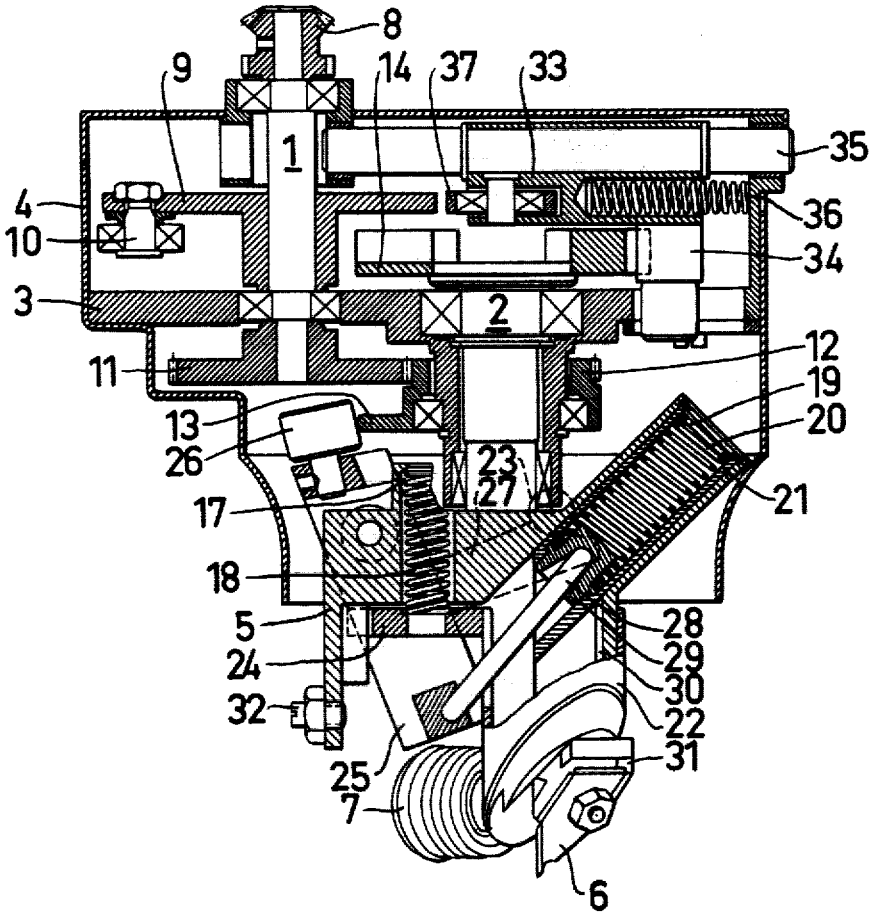
FIG. 1 is a vertical cross section through a working head according to the invention.

The cutting head according to FIG. 1 has a driving shaft 1 and a central shaft 2 which are mounted in a body 3 which is fixedly connected to a surrounding cap 4, a rotatable housing 5 which is fixedly connected to the lower part of the central shaft, and a knife 6 and a pressure roller 7 which are movably connected to the rotatable housing 5 so that they can be raised and lower respectively in relation to the cutting head.

Figure 2:
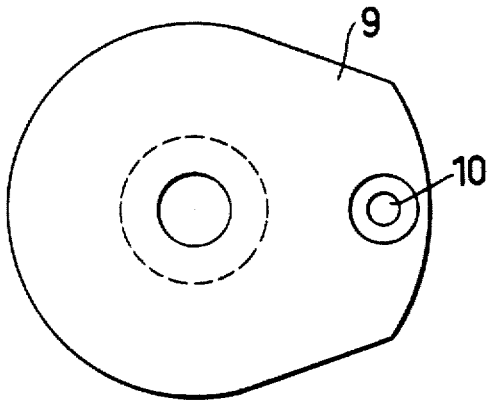
FIGS. 2–5 show different details of the cutting head according to FIG. 1; and, FIG. 6 is a diagrammatic perspective view of a passepartout-machine having a cutting head according to FIG. 1.
Figure 3:
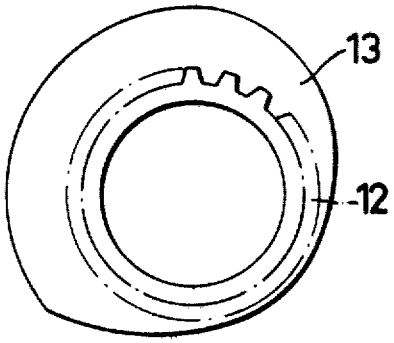

The driving shaft 1 is mounted both in the body 3 and in the top of the cap 4 and the upper part of the driving shaft which extends out through the cap is connected to an angle cog wheel 8 for connection of the cutting head to a motor for driving the mechanism of the cutting head for rotating, raising and lowering same respectively. On the driving shaft there is a cam disc 9 having a pin 10 in a ball bearing provided in the space between the top of the cap and the body. The appearance of said cam disc and the pin are evident from FIG. 2. Underneath the body the lower part of the driving shaft is connected to a cog wheel 11. About a downwards directed sleeve formed part of the body 3 enclosing a portion of the central shaft 2 a cog wheel 12 is mounted which with a lower portion is connected to a lift cam curve 13. The cog wheel 11 on the driving shaft 1 engages the said cog wheel 12 and thereby drives the lifter curve 13 which is shown in FIG. 3.

Figure 4:
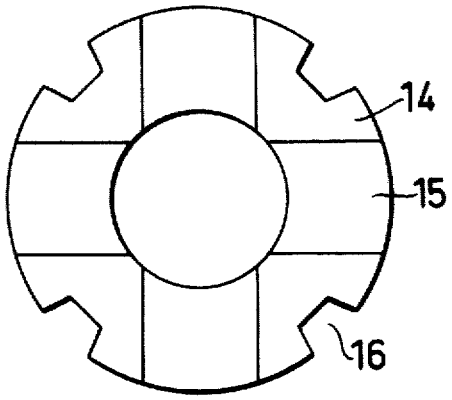

The upper end of the central shaft 2 is connected to a Maltese cross 14 in the grooves 15 of which the pin 10 of the cam disc 9 of the driving shaft 1 engages and provides a rotation. On the Maltese cross 14 as shown in FIG. 4, there are also recesses 16 making it possible to lock the Maltese cross. The lower end of the central shaft 2 is fixedly connected to the rotatable housing 5.

The rotatable housing 5 which is shown in a cross section of a plan in front of the central shaft 2 in FIG. 1 comprises a vertical space 17 for a first pressure spring and an obliquely extending space 19 for a second pressure spring 20 and a cylindrical sleeve 21. Around the lower vertical part of the rotatable housing 5 a slide 22 is movably mounted and also a rotatable bracket 25 is rotatably mounted on the housing 5.

Figure 5:
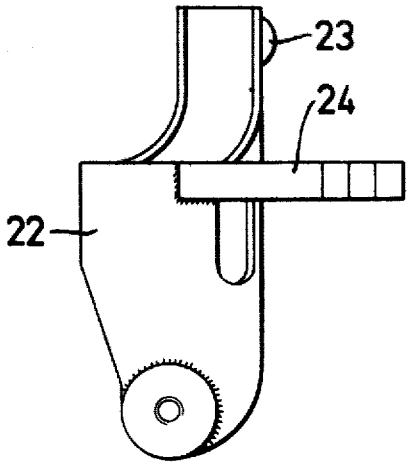

As evident from FIG. 5 the upper part of the slide 22 has a pin 23 and a projecting bracket 24 contacting the first pressure spring 18. The pressure roller 7 is connected to the lower part of the slide 22 and it is intended to secure the material to be cut during the cutting.

The rotatable bracket 25 which is rotatable in relation to the rotatable housing 5 is in the upper end thereof connected to a roller 26 for guiding the rotation. At the lower end of the bracket 25 there is a recess for a pin 28 the opposite end of which contacts the second pressure spring 20 in the rotatable housing over a pressure bushing 29. By the actuation of the said pressure spring 20 the roller 26 is brought into contact with the lifter curve 13. On the rotatable bracket 25 there is also an arm 27 which is formed so as to contact the pin 23 of the slide 22 from underneath, so that the slide 22 can be lowered and raised respectively as the bracket rotates.

In the obliquely extending space 19 of the rotatable housing 5 a cylindrical sleeve 21 is movably mounted. The lower part of the sleeve 21 is fixedly connected to a vertical holder 30 for the knife blade 6 and an adjustable mounting plate 31 therefore. The second pressure spring 20 is enclosed in the said cylindrical sleeve 21 and provides over the pressure bushing 29 a pressure to the pin 28 which is mounted in the rotatable bracket 25. An inner bulge of the cylinder wall provides a stop for the pressure spring 20 to keep the said spring in the cylindrical sleeve 21.

The knife blade 6 which is screw mounted in the adjustable mounting plate 31 can be adjusted to any suitable position by means of the mounting plate. The mounting plate is provided so that the knife blade gets an inclination to the surface of the material of about 45°. Also the cutting depth can be controlled by a control screw 32 which in an inner screw position reduces the movement of the rotatable bracket 25 and thereby the lower most position for the knife 6.

In the upper part of the cutting head there is a catch 33 having a locking wedge 34 which engages one of the recesses 16 of the Maltese cross 14 thereby locking the Maltese cross after having rotated one forth of a turn. The catch 33 is slidably connected to an upper horizontal guide shaft 35 and it is forced towards the Maltese cross by a pressure spring 36, the opposite end of which contacts the cap 4. On the part of the catch 33 which is opposite the end facing the pressure spring 36 there is a pin about which a ring 37 is mounted. The ring 37 contacts the ridge of the cam disc 9. At the said contact the catch 33 is pressed back and the locking wedge 34 leaves the recess 16 of the Maltese cross making a rotation thereof possible.

When the cutting head is used for cutting a passepartout and the knife has to be rotated 90° after reaching a corner the motor driving the cutting head is engaged for instance by optical sensing. Thereby the knife and the pressure roller are lifted whereupon they are rotated 90°, and finally they are lowered whereupon the motor is disconnected.

The said lifting, rotation and lowering is provided as follows: When the knife 6 and the pressure roller 7 are in their down positions as they are during the cutting operation the Maltese cross 14 is fixed in a position by the actuation of the locking wedge 34 which has entered one of the recesses 16 of the Maltese cross. Thereby the circular part of the cam disc 9 is adjacent the ring 37 of the catch means 33 which is therefore not pressurized. Further the roller 26 of the rotatable bracket 25 is contacting the narrower part of the lift curve 13, and the rotatable bracket 25 is in the end position thereof in which both the knife and the pressure roller are in their down positions.

When the driving shaft 1 is rotated the cam disc 9 and the lower cog wheel 11 of the driving shaft are rotated together with the driving shaft. The said lower cog wheel 11 engages the cog wheel 12 which is connected to the lifter curve 13 thereby rotating same. When the roller 26 mounted on the rotatable bracket 25 contacts the wider portion of the lifter curve 13 the rotatable bracket is transferred to its second end position in which the pin 28 mounted in the lower part of the rotatable bracket presses the cylindrical sleeve 21 together with the knife 6 connected thereto upwards, and the arm 27 of the rotatable bracket 25 lifts via the pin 23 the slide 22 together with the pressure roller 7 mounted thereon. Thereby the knife and the pressure roller have been lifted.

When the driving shaft 1 is further rotated the ridge of the cam disc 9 will in time come into contact with the ring 37 of the catch means 33 thereby compressing the catch means so that the locking wedge 34 no longer locks the Maltese cross 14. The pin 10 of the cam disc 9 thereafter engages one of the grooves 15 of the Maltese cross 14 bringing same to rotate one forth of a turn whereupon the Maltese cross is once again locked in that the locking wedge 34 is forced into the subsequent recess of the Maltese cross when the pressure on the catch ring is released. Thereby also the the central shaft 2 is rotated together with the rotatable housing and the cylindrical sleeve 21 and the knife and pressure roller carrying slide 22 connected to the rotatable housing 5. The knife and the pressure roller are still in their up positions but they have been rotated one forth of a turn, i.e. 90°.

When the driving shaft is further rotated the roller 26 of the rotatable bracket 25 pressed to the periphery of the lifter curve 13 will once again contact the narrow part thereof, whereby the knife and the pressure roller are lowered.

When raising the knife and the pressure roller the knife is lifted first since the cylindrical sleeve 21 to which the knife is connected is directly actuated by the movement of the rotatable bracket 25 over the pin 28 which is pressed to the lower part of the rotatable bracket by the pressure spring 20 in the obliquely extending space 19 of the rotatable housing. The pressure roller 7 which is connected to the slide 22 is not lifted until the arm 27 of the rotatable bracket 25 comes into contact with the projecting pin 23 of the slide which happens at a later moment. At the lowering following the rotation the pressure roller takes its down working position before the knife since the pin of the slide reaches its bottom position before the rotatable bracket has fulfilled its movement and thereby before the knife has reached its lower-most position.

As explained the driving shaft is rotated one turn at each corner, and since the Maltese cross is rotated one forth of a turn in the opposite direction during the said turn of the driving shaft the lifter curve must be changed in a relationship between the cog wheel of the driving shaft and the cog wheel connected to the lifter curve of 1,25:1,00 in order to be rotated one turn.

Figure 6:
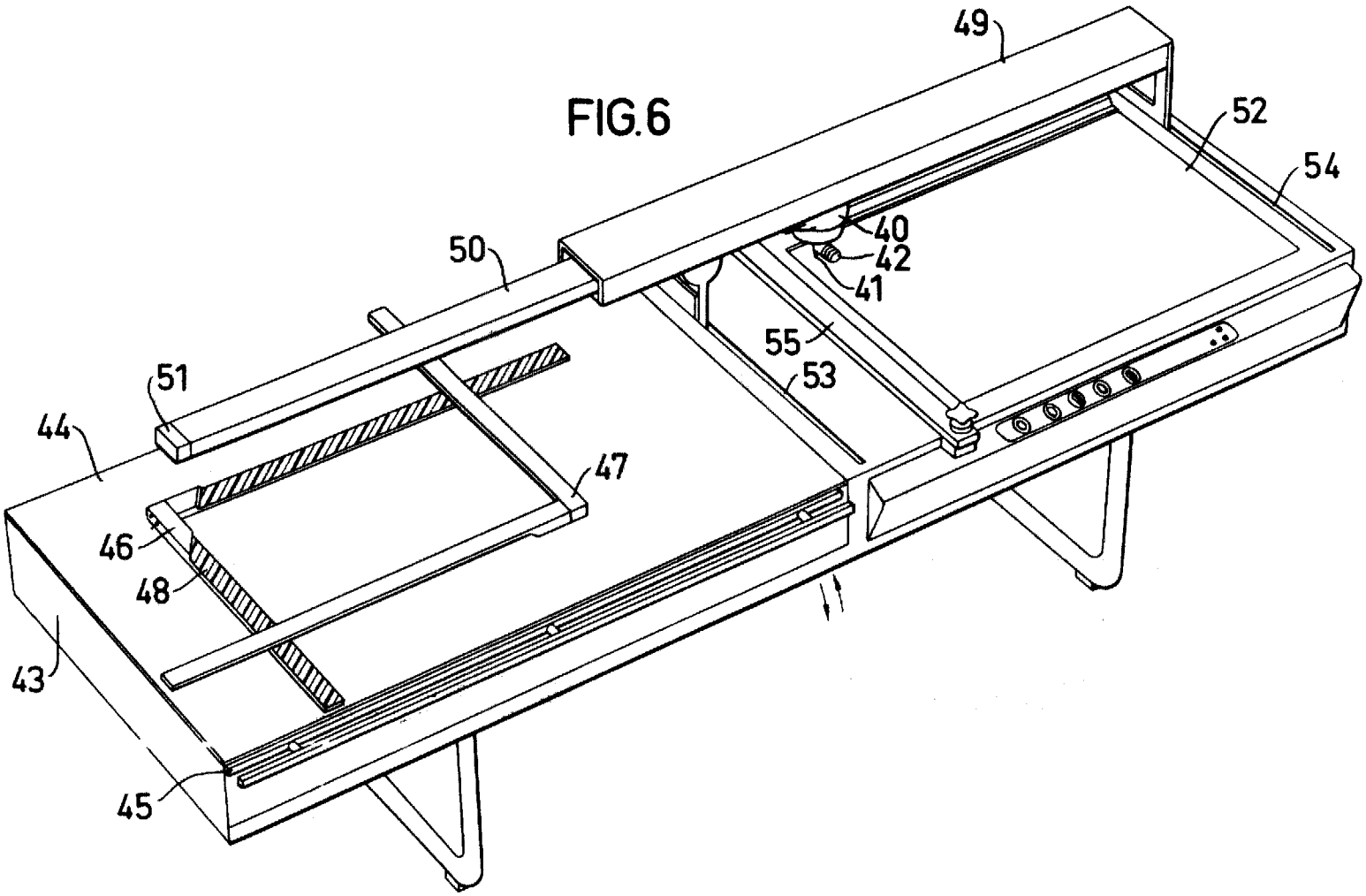

FIG. 6 shows a passepartout-machine having the above described cutting head as illustrated in FIGS. 1–5. By using the said machine an exactly cut passepartout can be obtained without any manual readjustments or movements by the hand.

The machine comprises a table 43 on which a glass plate 44 is provided and against which the original picture which is placed on 45 can be pressed from underneath. On the glass plate 44 there are two angle bars 46 and 47. The angle bar 46 is fixedly mounted whereas the angle bar 47 is movable in relation to the bar 46 so that the size of the opening provided by the combination of the two bars can be varied.

At the side of the glass plate 44 a cutting apparatus 49 is provided on the table 43 which comprises a telescopic arm 50 the outer end 51 of which can follow the contion of the angle bar opening photoelectrically. Thereby a movable cutting head 40 mounted on the telescopic arm 50 moves so that the knife 41 provided in the cutting head 40 cuts an opening in a cardboard plate 52. The size of the opening of the cardboard plate 52 corresponds to the size of the opening formed by the two angle bars 46 and 47.

When cutting opening sides which are parallel to the longitudinal direction of the table 43 the cutting head 40 is moved along the arm 50 and when cutting the opening sides which are parallel to the short sides of the table 43 the cutting head 40 together with the arm 50 is moved along grooves 53 and 54 of the table 43.

I claim:

1. A working head in an apparatus for providing rectangular cuttings in a plain material, comprising:

a holder, said holder having a knife and/or an impression roller mounted thereon, said holder being vertically slidably mounted on a rotatable housing, wherein in the lower position the knife is positioned to cut the plain material, said rotatable housing being fixedly mounted on a first shaft, a Maltese cross connected to the upper portion of said first shaft, a securing means positioned to selectively hold the Maltese cross secure at any given selected position, a drive shaft essentially parallel to said first shaft, said drive shaft operatively engaged with the first said shaft to turn the same, a first cam means operatively connected to the drive shaft to disengage the securing means of the Maltese cross and then permit the securing means to engage and secure the Maltese cross after a certain rotation of the drive shaft, and a second cam operatively connected to the drive shaft to cause the holder to rise up and away from the plain material and then to lower it again upon the said certain rotation of the drive shaft, whereby during said certain rotation of the drive shaft, the Maltese cross is freed to rotate, rotated by a given amount and then secured, while concurrently the holder with the knife and/or impression roller is raised and then lowered.

2. A working head according to claim 1, said certain rotation being one full turn of the drive shaft, and first and second cams constructed such that one full turn of the drive shaft effects a 90° rotation of the said first shaft, the Maltese cross and the knife.

3. A working head according to claim 1, wherein the Maltese cross has recesses in the periphery thereof, and wherein said securing means includes a locking wedge movable into said recesses to secure the Maltese cross in position.

4. Working head according to claim 1 or claim 2, characterized in that the rotatable housing (5) comprises a vertical space (17) for a first pressure spring (18), an obliquely extending space (19) for a second pressure spring (20) and a movable cylinder sleeve (21) on which the holder (30) for the knife (6) and/or the impression roller is mounted, and the housing (5) has a lower portion about which a slide (22) is movably mounted on which slide (22) the pressure roller (7) is mounted.

5. Working head according to claim 1 or claim 2, characterized in that a rotatable bracket (25) having a pin (28) and an arm (27) is rotatably connected to the rotatable housing (5), whereby the upper part of the rotatable bracket is connected to a roller (26) contacting the second cam curve (13) which is driven by the driving shaft (1) over cog wheels (11, 12), whereby the rotatable bracket (25) is brought to pivot between its two end position thereby providing a lifting and a lowering respectively of the holder (30) and the pressure roller (7).

6. Working head according to claim 5, characterized in that the cog wheel (11) on the driving shaft (1) and the cog wheel (12) on the second cam curve (13) have a gear exchange reduction of 1,25:1,00, so that the second cam curve is rotated one turn when the driving shaft is rotated one turn.

7. Working head according to claim 6, characterized in that the cylindrical sleeve (21) encloses the pressure spring (20) the upper end of which is biased against a pressure bushing (29) which is kept in the cylindrical sleeve (21) by an inner bulge thereof, and in that the pin (28) which is connected to the lower part of the rotatable bracket (25) is biased against the lower side of the pressure bushing (29), so that the cylindrical sleeve (21) is forced into the obliquely extending space (19) by the pin (28) when the rotatable bracket pivots between its two end positions and is forced downwards respectively by the pressure spring (20), so that the holder (30) connected to the cylindrical sleeve is raised and lowered respectively.

8. Working head according to claim 7, characterized in that the slide (22) has a pin (23) at the underside of which the arm (27) of the rotatable bracket (25) can rest, and in that the slide (22) has a projecting bracket (24) in contact with the pressure spring (18) provided in the vertical space (17) of the rotatable housing (5), whereby the slide (22) is lifted by the arm (27) and is pressed down by the pressure spring (18) respectively when the rotatable bracket (25) pivots between its end positions, so that the pressure roller (7) mounted on the slide (22) is lifted and lowered respectively.

9. Working head according to claim 8, characterized in that the pin (23) of the slide (22) is located slightly above the arm (27) of the rotatable bracket (25) when the slide is in its down working position, whereby the holder (30) is lifted in advance of the pressure roller and reaches its working position before the holder when the lifter cam curve (13) is rotated one turn and the rotatable bracket pivots between its end positions.

10. Working head according to claim 1 or claim 2 characterized in that the holder (30) is connected to an adjustable mounting plate (31) in which a knife blade (6) is mounted.

11. Working head according to claim 10, characterized in that the depth of cutting is adjustable by means of a control screw (32) which controls the pivot movements of the rotatable bracket (25) and thereby the lowermost positon for the knife (6).

12. Working head according to claim 11, characterized in that the knife (6) is sloping 45° towards the plain of the material to be cut.

13. Working head according to claim 1 or claim 2, characterized in that the holder (30) is connected to an impression roller.

14. A working head according to claim 3, including a catch, means for horizontally sliding said catch along a guide shaft, said locking wedge connected to said catch, said catch being spring biased in a direction to urge the locking wedge into the recesses of the Maltese cross, and wherein the end of the catch opposite from the end having the locking wedge engages the said first cam, whereby when engaged the first cam urges the catch horizontally, opposing the spring and moving the locking wedge out of engagement with the recesses of the Maltese cross.

* * * * *